US007819623B2

(12) United States Patent
Sutherland et al.

(10) Patent No.: US 7,819,623 B2
(45) Date of Patent: Oct. 26, 2010

(54) CLEARANCE CONTROL APPARATUS

(75) Inventors: Roger A Sutherland, Derby (GB); Colin R Barnfather, Derby (GB); Jonathan E Holt, Derby (GB); Christopher D Jack, Derby (GB); Ralph W Hill, Matlock (GB)

(73) Assignee: Rolls-Royce plc, London (GB)

( * ) Notice: Subject to any disclaimer, the term of this patent is extended or adjusted under 35 U.S.C. 154(b) by 748 days.

(21) Appl. No.: 11/797,820

(22) Filed: May 8, 2007

(65) Prior Publication Data

US 2008/0063509 A1 Mar. 13, 2008

(30) Foreign Application Priority Data

May 11, 2006 (GB) ..... 0609312.4

(51) Int. Cl.
*F01D 11/24* (2006.01)

(52) U.S. Cl. ..... 415/116; 415/173.1; 415/118

(58) Field of Classification Search ..... 415/119, 415/173.1, 116, 118; 701/100
See application file for complete search history.

(56) References Cited

U.S. PATENT DOCUMENTS 4,213,296 A 7/1980 Schwarz
4,257,222 A 3/1981 Schwarz
4,893,983 A * 1/1990 McGreehan ..... 415/48
4,928,240 A * 5/1990 Davison et al. ..... 701/100
5,012,420 A * 4/1991 Walker et al. ..... 701/100
6,109,783 A * 8/2000 Dobler et al. ..... 374/131
6,487,491 B1 * 11/2002 Karpman et al. ..... 701/100

FOREIGN PATENT DOCUMENTS

EP 1 004 759 A 7/2002
JP 2002285803 10/2002

* cited by examiner

*Primary Examiner*—Ninh H Nguyen
(74) *Attorney, Agent, or Firm*—Jeffrey S. Melcher; Manelli Denison & Selter PLLC

(57) ABSTRACT

A clearance control apparatus for controlling the clearance between a rotary assembly (17) and a casing (24) surrounding the rotary assembly (17) is disclosed. The clearance control apparatus comprises a temperature measuring device (34) to measure the temperature of a radially outer portion of the rotary assembly and a cooling arrangement (28) to cool the casing (24). A control system (36) is associated with the temperature measuring device (34) and the cooling arrangement (28) to control the extent of cooling of the casing (24). The extent of cooling is dependent upon the temperature of the aforesaid portion.

30 Claims, 5 Drawing Sheets

CLEARANCE CONTROL APPARATUS

This application claims priority to British Patent App'n Ser. No. 0609312.4, field 11 May 2006.

FIELD OF THE INVENTION

This invention relates to clearance control apparatus for controlling the clearance between rotary assemblies and the casing surrounding the rotary assemblies. More particularly, but not exclusively the invention relates to clearance control apparatus for controlling the clearance between the blade tips for turbine and the turbine casing.

BACKGROUND OF THE INVENTION

Gas turbine efficiency is affected by the clearance between the tip of a turbine blade and the turbine casing. Clearance needs to be minimised for maximum turbine efficiency.

Turbine design calculations take into account all the related thermal expansions. The clearance is consequently set to avoid causing the tips of the blades to rub against the casing during certain manoeuvres. The design considerations ensure that the clearance is optimum at, for example, steady state operation. However, there is no control of the clearance during none steady state performance.

SUMMARY OF THE INVENTION

According to one aspect of this invention, there is provided a clearance control apparatus for controlling the clearance between a rotary assembly and a casing surrounding the rotary assembly, said apparatus comprising a temperature measuring device to measure the temperature of a portion of the rotary assembly, a cooling arrangement to cool the casing, and a control system associated with the temperature measuring device and the cooling arrangement to control the extent of cooling of the casing, said extent of cooling being dependent upon the temperature of the aforesaid portion.

Preferably, said portion of the rotary assembly is an outer portion.

Thus, in the preferred embodiment, the cooling arrangement controls the extent of thermal expansion of the casing and thereby maintains a desired clearance between the casing and the rotary assembly.

The preferred embodiment of the clearance control apparatus is suitable for use with a rotary assembly having a rotary support member and a radially outer portion comprising a plurality of circumferentially mounted, radially outwardly extending blades, for example a turbine.

The preferred embodiment of the clearance control apparatus advantageously controls the clearance between the tips of the blades and the casing, which surrounds the blades.

The cooling arrangement may comprise a supply of a cooling medium, whereby the cooling medium is supplied to the casing to cool it. Preferably, the cooling arrangement includes a flow regulator, which advantageously regulates the supply of the cooling medium to the casing. The cooling arrangement may comprise a conduit arrangement to carry the cooling medium. Preferably the cooling medium is air. The flow regulator is conveniently mounted in the conduit arrangement to regulate the flow of the cooling medium therethrough.

The temperature measuring device may comprise a pyrometer.

The control system is preferably an electronic control system. The temperature measuring device may be arranged to provide a temperature signal to the control system, said temperature signal relating to the temperature of said outer portion of the rotary assembly. Preferably, the control system is configured to transmit a flow regulation signal to the flow regulator to regulate the flow of the cooling medium through the flow regulator. The flow regulator may comprise a valve and the control means may transmit the flow regulation signal to open or close the valve by a desired extent, to increase or reduce the flow of said fluid therethrough.

Preferably, the control system is programmed to calculate the extent of expansion of the radially outer portion of the rotary assembly, based on the temperature of radially outer portion.

Desirably, the control system is programmed to calculate the supply condition of the cooling medium. For example, the control system may calculate the supply condition of the cooling medium in terms of the temperature and pressure as a function of engine condition.

Preferably, the rotary assembly comprises a rotary member upon which the radially outer portion is provided. The rotary member may be a disc upon which the blades are mounted.

Desirably, the control system can calculate the diameter of the rotary member, said calculation being based upon engine performance parameters. The engine performance parameters may be provided for reasons not connected with the present invention, such as for engine control.

Preferably the control system can calculate the diameter of the casing based on the condition of the engine and the extent of cooling by the cooling medium.

The apparatus may include a position sensor which may be provided on the flow regulator to provide a flow regulation feedback signal to the control system, said flow regulation feedback signal relating to the condition of the flow regulator, and the extent of supply of the cooling medium, thereby enabling the control system, in the preferred embodiment, to determine more accurately the rate of flow of the cooling medium, and to adjust the flow regulator as appropriate.

The apparatus may include a flow sensor, which may be provided upstream or downstream of the flow regulator. The flow sensor may provide a flow rate feedback signal to the control system, whereby the control system can control the flow regulator to adjust the rate of flow of fluid therethrough, as appropriate. In the preferred embodiment, this feature provides the advantage of being able to control more accurately the rate of flow of the cooling medium.

The apparatus may include a temperature sensor on the casing to provide a casing temperature feedback signal to the control system to enable the control system to determine the extent of expansion of the casing, and thereby allow the control means control the flow regulator to regulate the rate of flow of the cooling medium to adjust the extent of expansion of the casing.

The apparatus may include a rotary member temperature sensor means to sense the temperature of the rotary member to measure the temperature of cooling air supplied to the rotary assembly. The apparatus may include a first rotary member temperature sensor upstream of the rotary assembly and second rotary member temperature sensor downstream of the rotary assembly. The, or each, rotary member temperature sensor may provide a respective feedback signal relating to the temperature of the support member, in the preferred embodiment, this feature has the advantage of allowing accurate measurement of the extent of expansion of the rotary support member.

BRIEF DESCRIPTION OF THE DRAWINGS

At least one embodiment of the invention will now be described by way of example only, with reference to the accompanying drawings, in which.

DETAILED DESCRIPTION OF THE INVENTION

Figure 1:
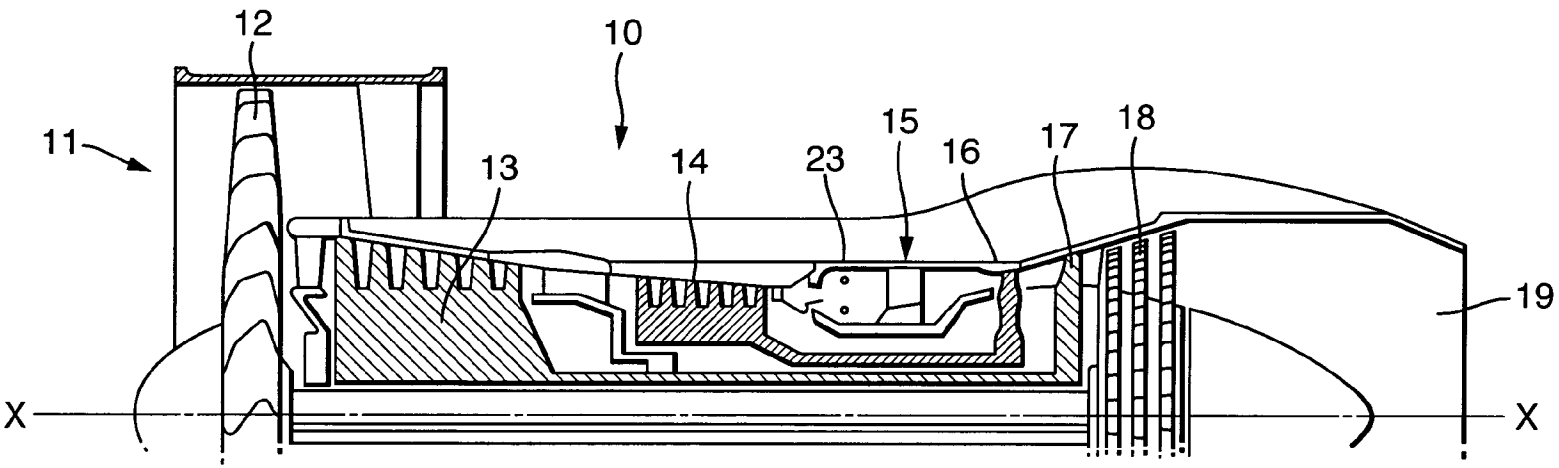
FIG. 1 is a sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

Figure 2:
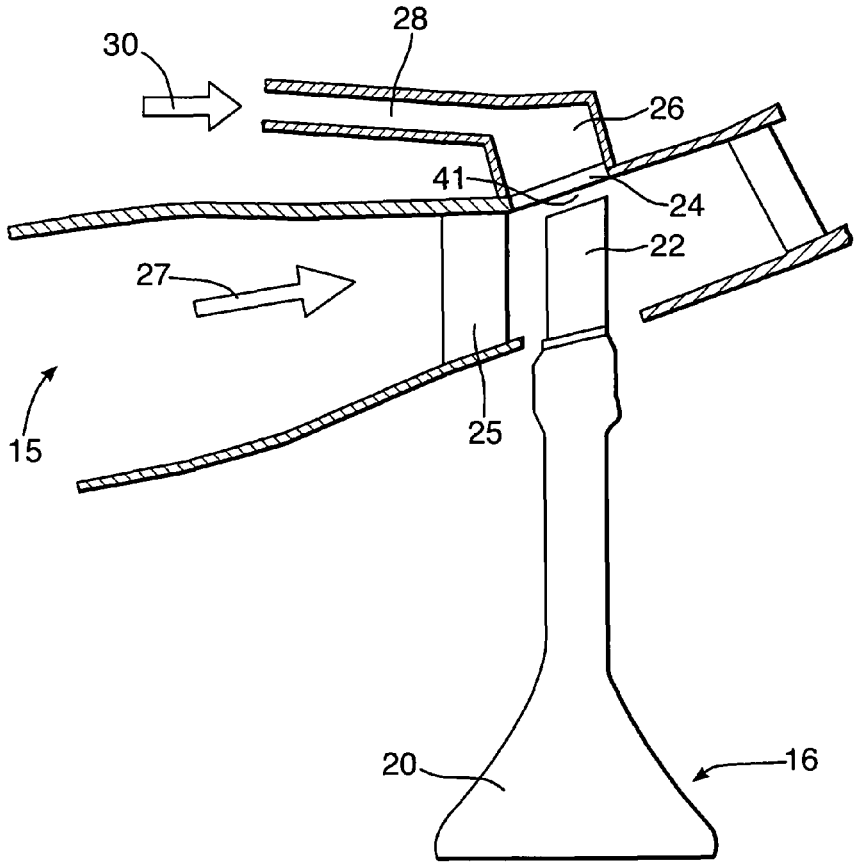
FIG. 2 is a diagrammatic sectional side view of the upper half of a turbine.
Figure 3:
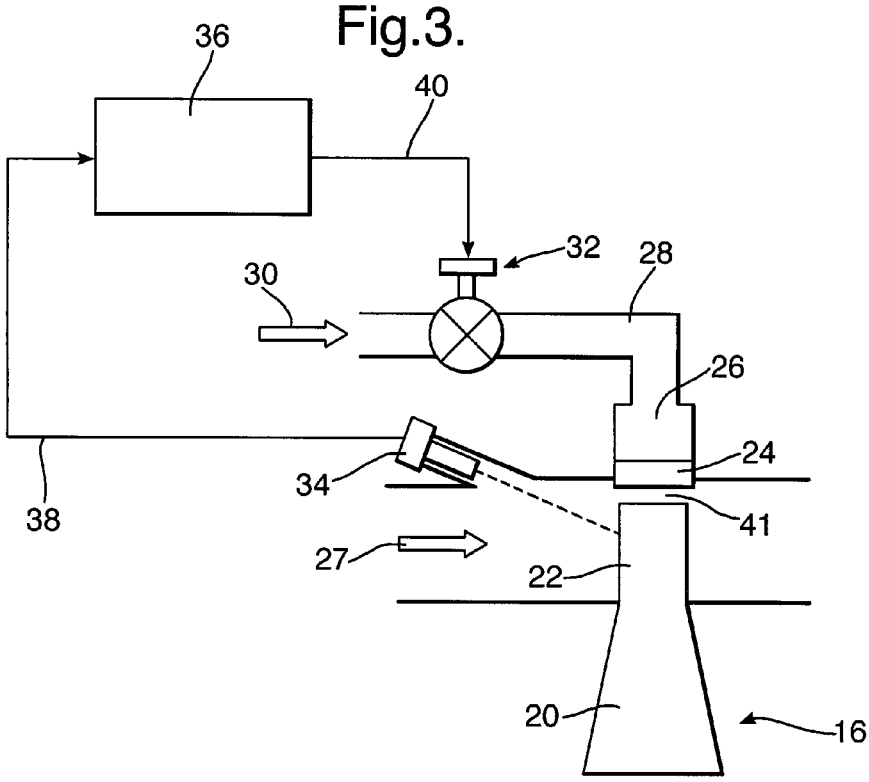
FIGS. 3 to 7 are diagrammatic sectional side views of the respective different embodiments of a turbine incorporating a clearance control arrangement.

Referring to FIG. 2, there is a sectional side view of the upper half of a turbine, for example the high pressure turbine 16. The turbine 16 comprises a rotary support disc 20 upon which is mounted a plurality of radially outwardly extending blades 22, circumferentially around the disc 20 in FIG. 2. Only one of the blades 22 is shown for clarity. The turbine blades are surrounded by an annular casing 24. A plurality of nozzle guide vanes 25 (only one of which is shown for clarity) are circumferentially arranged upstream of the turbine blades 22 to direct air from the combustor 15 onto the turbine blades 22 as shown by the arrow 27. The casing 24 has mounted thereon an annular plenum chamber 26 extending therearound which is supplied with cooling air via a conduit arrangement 28. The conduit arrangement 28 extends to a source of cooling air as represented by the arrow 30, via a flow regulator 32, which is shown in FIG. 3. The plenum chamber 26 and the conduit arrangement 28 form part of a clearance control arrangement, as explained below, to control the clearance between the radially outer tips of the blades 22 and the radially inner wall of the casing 24.

Referring to FIG. 3, there is shown schematically, the high pressure turbine 16, in which a flow regulator 32 is provided in the conduit arrangement 28 to regulate the flow of air passing therethrough.

Temperature measuring means in the form of a pyrometer 34 is provided upstream of the turbine 17, and is mounted radially outwardly therefrom. The pyrometer 34 is directed towards the turbine blades 22.

An electronic controller 36 is connected to the pyrometer 34 and to the flow regulator 32, as represented by the arrows 38, 40 respectively.

In use, the rotation of a turbine 17 is effected by the combustion gases from the combustor 15. The combustion gases are at exceedingly high temperatures which causes expansion of the turbine blades 22 and of the casing 24. In order to ensure that a desired clearance is maintained between the tips of the turbine blades 22 and the casing 24, the pyrometer 34 measures the temperature of the turbine blades 22. A signal relating to the temperature of the blades 22 is passed to the controller 36 which is programmed to calculate from the temperature signal the likely extent of expansion of the turbine blades 22. The controller then activates the flow regulator 32 so that a flow of air passes to the plenum chamber 26 to provide appropriate cooling to the casing 24 to mitigate the expansion and maintain a desired clearance 41 between the tip of the turbine blades 22 and the casing 27.

In general, the measurement of the temperature of the turbine blades is carried out at various stages in the flight cycle, particularly during cruise. The pyrometer 34 provides an indication of the temperature of the turbine blades 22 as a function of the emitted infra red radiation from the turbine blades 22.

The controller 36 is programmed to calculate the height of the blades 22 as a function of the relayed temperature measured by the pyrometer 34 and the turbine blade material properties. The controller 36 then calculates the supply condition for the cooling air in terms of the temperature and pressure of the air as a function of engine condition. The controller 36 also calculates the diameter of the turbine support disc as a function of the engine condition, and calculates the diameter of the casing 24, as a function of the engine condition and the temperature and pressure of the cooling air. Thus, in effect, the controller 36 controls a supply of cooling air to the casing 24 to limit the expansion of the casing 24 and maintain a desired clearance between the tips of the turbine blades 22 and the casing 24.

Figure 4:
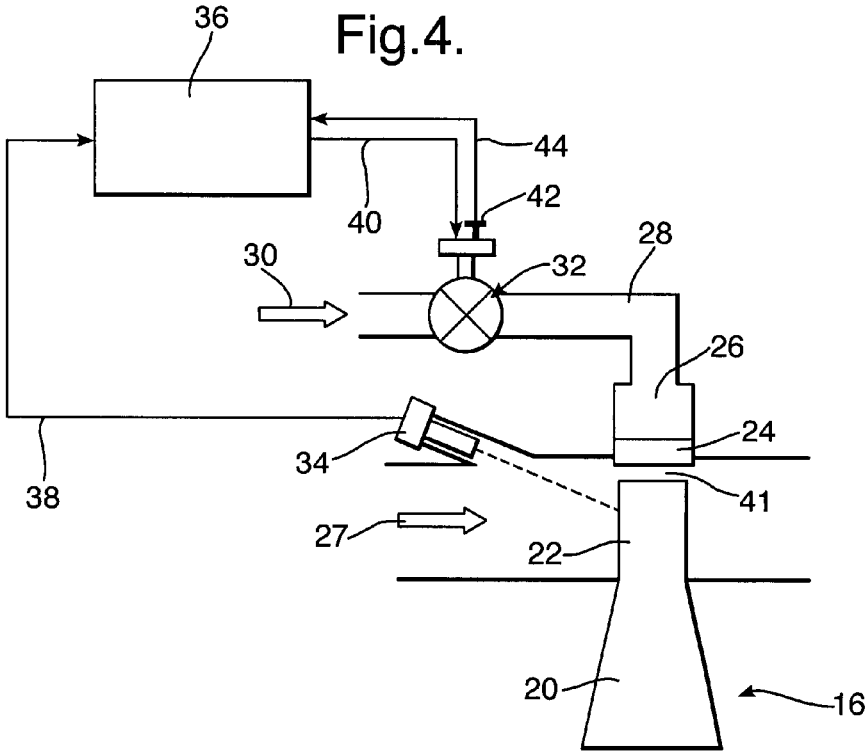

FIG. 4 shows a further embodiment, which comprises many of the same features as shown in FIG. 3 and these have been designated with the same reference numerals. In FIG. 4 a position sensor 42 is provided on the flow regulator 32 to provide a position feedback signal to the controller 36 relating to the setting of the flow regulator 32. The connection of the position sensor 42 to the controller 36 is represented by the arrow 44. This signal enables the controller 36 to control more accurately the setting of the flow regulator 32 and thereby the extent of supply of cooling air to the annular plenum chamber 26.

Figure 5:
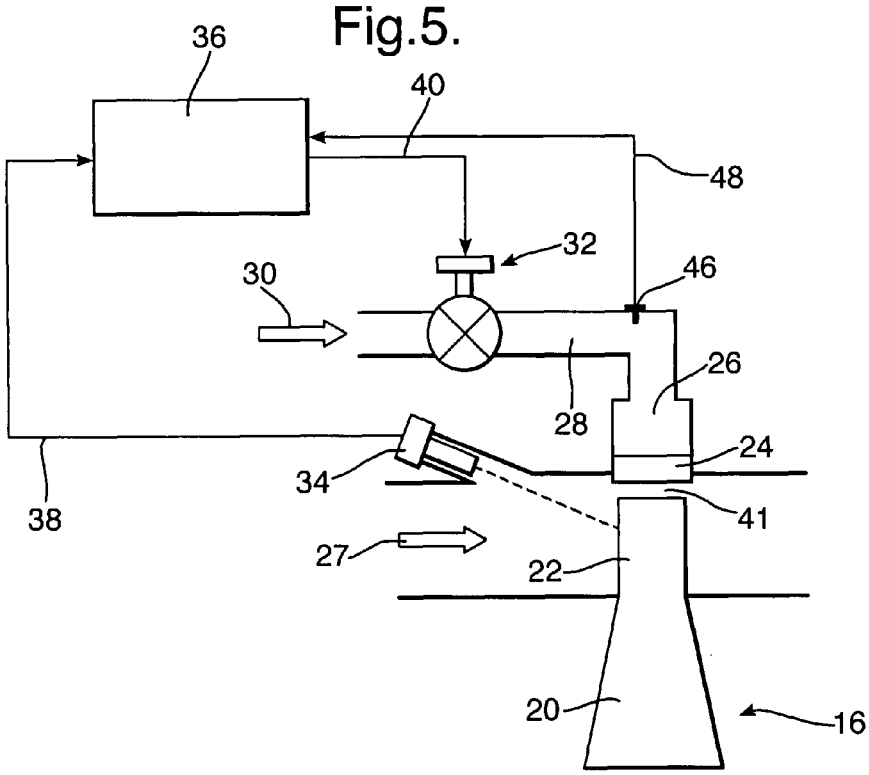

FIG. 5 shows a further embodiment which also comprises many of the same features as shown in FIG. 3, and these have again been designated with the same reference numerals, in which a flow sensor 46 is provided downstream of the flow regulator 32 to sense the level of cooling air supplied to a plenum chamber 26. The connection of the flow sensor 46 to the controller 36 is represented. A flow sensor feedback signal is provided to the controller 36 from the position sensor 44 to enable the controllers to regulate the level of cooling air supplied to the plenum chamber 26.

Figure 6:
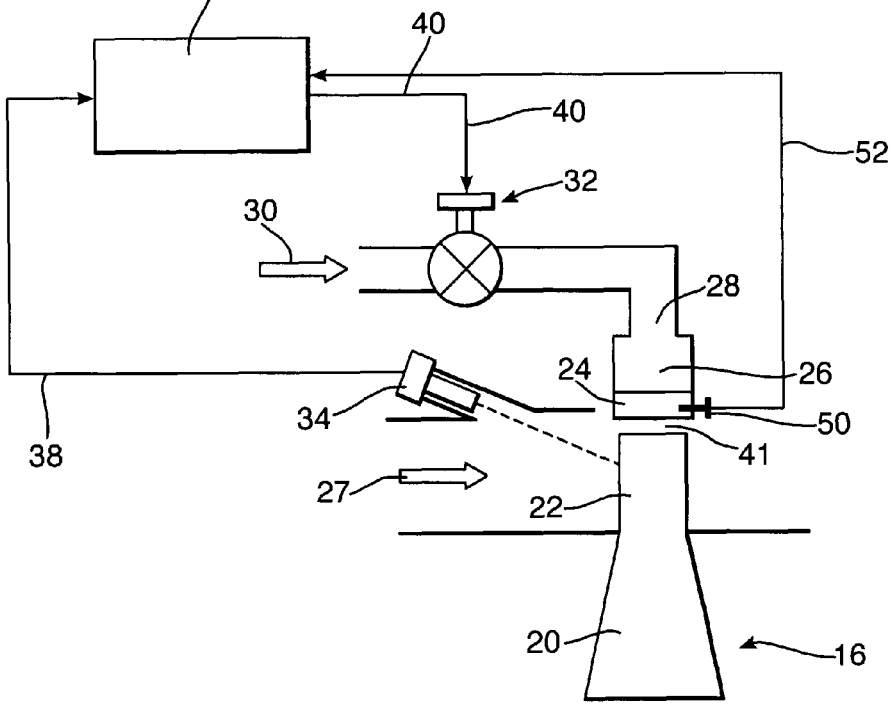

In a further embodiment shown in FIG. 6, which also comprises many of the same features as shown in FIG. 3, and these have again been designated with the same reference numerals, a temperature sensing device 50 is provided in the casing 24 to sense the temperature of the casing. The connection of the temperature sensing device 50 to the controller 36 is represented by the arrow 52. A temperature casing feedback signal is provided to the controller 36 which enables it to calculate the extent of expansion of the casing 24 based on the temperature of the casing 24 and thereby enables it to adjust the flow regulator 32 to provide a supply of cooling air accordingly.

Figure 7:
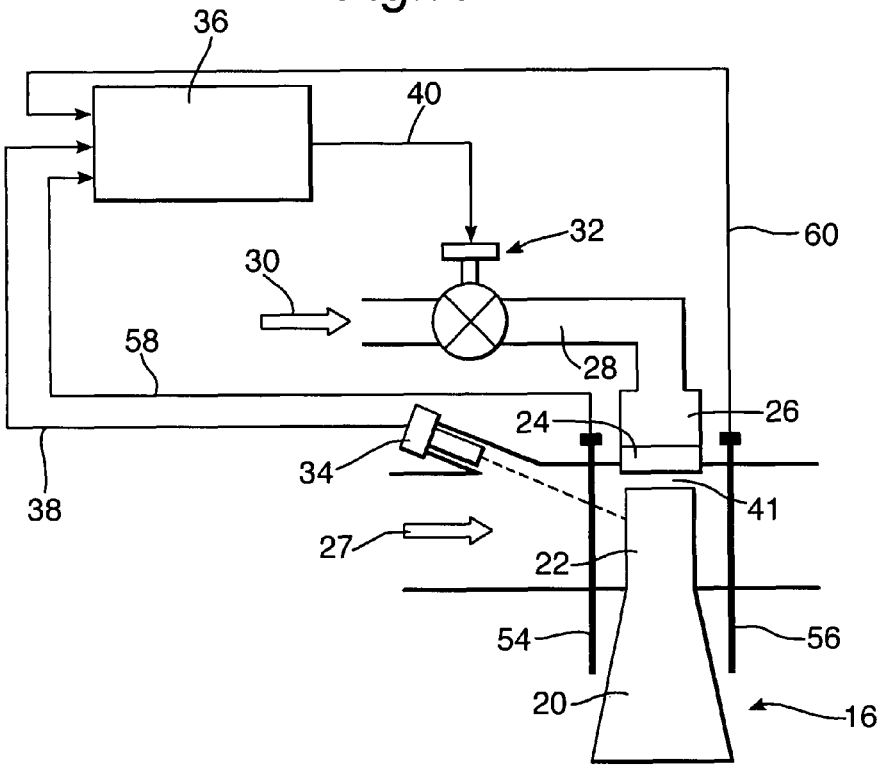

In the embodiment shown in FIG. 7, which also comprises many of the same features as shown in FIG. 3, and these have again been designated the same reference numerals, the first and second temperature sensors 54, 56 are provided to sense the temperature of cooling air upstream and downstream respectively of the turbine rotary disc support 20 and thereby provide respective first and second disc temperature feedback signals to the controller. The connection of the first and second temperature sensors 54, 56 to the controller 36 is represented respectively by the arrows 58, 60. This allows the controller to determine accurately the level of expansion of the turbine disc and thereby obtain a more accurate indication of the clearance between the turbine blade tip and the casing.

Although as shown in FIG. 7 the first or upstream temperature sensor 54 appears to be directly in line with the pyrometer 34, it will be appreciated that, the upstream temperature sensor 54 is, in fact, circumferentially offset from the pyrometer 34.

It will be appreciated that an embodiment of the clearance control arrangements may comprise any or all of the features described with reference to FIGS. 2 to 7.

Various modifications can be made without departing from the scope of the invention.

We claim:

1. A clearance control apparatus for controlling the clearance between a rotary assembly and a casing surrounding the rotary assembly, said apparatus comprising:

a temperature measuring device to measure the temperature of a portion of the rotary assembly;

a cooling arrangement to cool the casing comprising a supply of a cooling medium, a conduit for supplying the cooling medium from the supply to the casing to cool the casing, and a flow regulator to regulate the flow of cooling medium from the supply to the casing; and a control system associated with the temperature measuring device and the cooling arrangement to control the extent of cooling of the casing, said extent of cooling being dependent upon the temperature of the aforesaid portion, wherein the flow regulator comprises a valve and the control system transmits the flow regulation signal to open or close the valve by a desired extent and a position sensor on the flow regulator to provide a flow regulation feedback signal to the control system, said flow regulation feedback signal relating to the condition of the flow regulator and the extent of supply of the cooling medium, said flow regulation signal being based upon said flow regulation feedback signal.

2. A clearance control apparatus according to claim 1 wherein said portion of the rotary assembly is an outer portion of the rotary assembly, the rotary assembly comprises a rotary support member, and the outer portion comprises a plurality of radially outward extending blades circumferentially mounted around the rotary support member.

3. A clearance control arrangement according to claim 1, wherein the flow regulator is mounted in the conduit to regulate the flow of the cooling medium therethrough.

4. A clearance control arrangement according to claim 1, wherein the control system calculates the extent of expansion of the radially outer portion of the rotary assembly, based on the temperature of said radially outer portion, and transmits said flow regulation signal based on said calculation.

5. A clearance control arrangement according to claim 1, wherein the rotary assembly comprises a rotary member upon which said portion is provided, and the control system can calculate the diameter of the rotary member, said calculation being based upon engine performance parameters, said flow regulation signal being based upon said calculation of the diameter of the rotary member.

6. A clearance control arrangement according to claim 1, wherein the control system calculates the diameter of the casing based on the condition of the engine and the extent of cooling by the cooling medium, whereby said flow regulation is based upon said calculation of the diameter of the casing.

7. A clearance control apparatus for controlling the clearance between a rotary assembly and a casing surrounding the rotary assembly, said apparatus comprising:

a temperature measuring device to measure the temperature of a portion of the rotary assembly;

a cooling arrangement to cool the casing comprising a supply of a cooling medium, a conduit for supplying the cooling medium from the supply to the casing to cool the casing, and a flow regulator to regulate the flow of cooling medium from the supply to the casing; and a control system associated with the temperature measuring device and the cooling arrangement to control the extent of cooling of the casing, said extent of cooling being dependent upon the temperature of the aforesaid portion, wherein the flow regulator comprises a valve and the control system transmits the flow regulation signal to open or close the valve by a desired extent, wherein a flow sensor is provided upstream or downstream of the flow regulator, the flow sensor providing a flow rate feedback signal to the control system, and said flow regulation signal being based upon said flow rate feedback signal.

8. A clearance control apparatus according to claim 7, wherein said portion of the rotary assembly is an outer portion of the rotary assembly, the rotary assembly comprises a rotary support member, and the outer portion comprises a plurality of radially outward extending blades circumferentially mounted around the rotary support member.

9. A clearance control arrangement according to claim 7, wherein the flow regulator is mounted in the conduit to regulate the flow of the cooling medium therethrough.

10. A clearance control arrangement according to claim 7, wherein the control system calculates the extent of expansion of the radially outer portion of the rotary assembly, based on the temperature of said radially outer portion, and transmits said flow regulation signal based on said calculation.

11. A clearance control arrangement according to claim 7, wherein the rotary assembly comprises a rotary member upon which said portion is provided, and the control system can calculate the diameter of the rotary member, said calculation being based upon engine performance parameters, said flow regulation signal being based upon said calculation of the diameter of the rotary member.

12. A clearance control arrangement according to claim 7, wherein the control system calculates the diameter of the casing based on the condition of the engine and the extent of cooling by the cooling medium, whereby said flow regulation is based upon said calculation of the diameter of the casing.

13. A clearance control apparatus for controlling the clearance between a rotary assembly and a casing surrounding the rotary assembly, said apparatus comprising:

a temperature measuring device to measure the temperature of a portion of the rotary assembly;

a cooling arrangement to cool the casing comprising a supply of a cooling medium, a conduit for supplying the cooling medium from the supply to the casing to cool the casing, and a flow regulator to regulate the flow of cooling medium from the supply to the casing; and a control system associated with the temperature measuring device and the cooling arrangement to control the extent of cooling of the casing, said extent of cooling being dependent upon the temperature of the aforesaid portion, wherein the flow regulator comprises a valve and the control system transmits the flow regulation signal to open or close the valve by a desired extent, wherein a casing temperature sensor is provided to sense the temperature of the casing and to provide a casing temperature feedback signal to the control system to enable the control system to determine the extent of expansion of the casing, and said flow regulation signal being based upon said casing temperature feedback signal.

14. A clearance control apparatus according to claim 13, wherein said portion of the rotary assembly is an outer portion of the rotary assembly, the rotary assembly comprises a rotary support member, and the outer portion comprises a plurality of radially outward extending blades circumferentially mounted around the rotary support member.

15. A clearance control arrangement according to claim 13, wherein the flow regulator is mounted in the conduit to regulate the flow of the cooling medium therethrough.

16. A clearance control arrangement according to claim 13, wherein the control system calculates the extent of expansion of the radially outer portion of the rotary assembly, based on the temperature of said radially outer portion, and transmits said flow regulation signal based on said calculation.

17. A clearance control arrangement according to claim 13, wherein the rotary assembly comprises a rotary member upon which said portion is provided, and the control system can calculate the diameter of the rotary member, said calculation being based upon engine performance parameters, said flow regulation signal being based upon said calculation of the diameter of the rotary member.

18. A clearance control arrangement according to claim 13, wherein the control system calculates the diameter of the casing based on the condition of the engine and the extent of cooling by the cooling medium, whereby said flow regulation is based upon said calculation of the diameter of the casing.

19. A clearance control apparatus for controlling the clearance between a rotary assembly and a casing surrounding the rotary assembly, said apparatus comprising:

a temperature measuring device to measure the temperature of a portion of the rotary assembly;

a cooling arrangement to cool the casing comprising a supply of a cooling medium, a conduit for supplying the cooling medium from the supply to the casing to cool the casing, and a flow regulator to regulate the flow of cooling medium from the supply to the casing; and a control system associated with the temperature measuring device and the cooling arrangement to control the extent of cooling of the casing, said extent of cooling being dependent upon the temperature of the aforesaid portion, wherein the flow regulator comprises a valve and the control system transmits the flow regulation signal to open or close the valve by a desired extent, wherein a rotary member temperature sensor is provided to sense the temperature of the rotary member to measure the temperature of cooling air supplied to the rotary assembly, and to provide a rotary member temperature feedback signal to the control system, said flow regulation signal being based upon said rotary member temperature feedback signal.

20. A clearance control apparatus according to claim 19, wherein said portion of the rotary assembly is an outer portion of the rotary assembly, the rotary assembly comprises a rotary support member, and the outer portion comprises a plurality of radially outward extending blades circumferentially mounted around the rotary support member.

21. A clearance control arrangement according to claim 19, wherein the flow regulator is mounted in the conduit to regulate the flow of the cooling medium therethrough.

22. A clearance control arrangement according to claim 19, wherein the control system calculates the extent of expansion of the radially outer portion of the rotary assembly, based on the temperature of said radially outer portion, and transmits said flow regulation signal based on said calculation.

23. A clearance control arrangement according to claim 19, wherein the rotary assembly comprises a rotary member upon which said portion is provided, and the control system can calculate the diameter of the rotary member, said calculation being based upon engine performance parameters, said flow regulation signal being based upon said calculation of the diameter of the rotary member.

24. A clearance control arrangement according to claim 19, wherein the control system calculates the diameter of the casing based on the condition of the engine and the extent of cooling by the cooling medium, whereby said flow regulation is based upon said calculation of the diameter of the casing.

25. A clearance control apparatus for controlling the clearance between a rotary assembly and a casing surrounding the rotary assembly, said apparatus comprising:

a temperature measuring device to measure the temperature of a portion of the rotary assembly;

a cooling arrangement to cool the casing comprising a supply of a cooling medium, a conduit for supplying the cooling medium from the supply to the casing to cool the casing, and a flow regulator to regulate the flow of cooling medium from the supply to the casing; and a control system associated with the temperature measuring device and the cooling arrangement to control the extent of cooling of the casing, said extent of cooling being dependent upon the temperature of the aforesaid portion, wherein the flow regulator comprises a valve and the control system transmits the flow regulation signal to open or close the valve by a desired extent, wherein a first rotary member temperature sensor is provided upstream of the rotary assembly and second rotary member temperature sensor is provided downstream of the rotary assembly, each rotary member temperature sensor providing a respective rotary member temperature feedback signal relating to the temperature of the rotary member to allow measurement of the extent of expansion of the rotary support member, and said flow regulation feedback signal being based upon each of said rotary member temperature feedback signals.

26. A clearance control apparatus according to claim 25, wherein said portion of the rotary assembly is an outer portion of the rotary assembly, the rotary assembly comprises a rotary support member, and the outer portion comprises a plurality of radially outward extending blades circumferentially mounted around the rotary support member.

27. A clearance control arrangement according to claim 25, wherein the flow regulator is mounted in the conduit to regulate the flow of the cooling medium therethrough.

28. A clearance control arrangement according to claim 25, wherein the control system calculates the extent of expansion of the radially outer portion of the rotary assembly, based on the temperature of said radially outer portion, and transmits said flow regulation signal based on said calculation.

29. A clearance control arrangement according to claim 25, wherein the rotary assembly comprises a rotary member upon which said portion is provided, and the control system can calculate the diameter of the rotary member, said calculation being based upon engine performance parameters, said flow regulation signal being based upon said calculation of the diameter of the rotary member.

30. A clearance control arrangement according to claim 25, wherein the control system calculates the diameter of the casing based on the condition of the engine and the extent of cooling by the cooling medium, whereby said flow regulation is based upon said calculation of the diameter of the casing.

* * * * *